US008215035B2

(12) United States Patent
Mills et al.

(10) Patent No.: US 8,215,035 B2
(45) Date of Patent: Jul. 10, 2012

(54) ATHLETIC SHOE HAVING AN IMPROVED CLEAT ARRANGEMENT AND IMPROVED CLEAT

(75) Inventors: David Mills, St. Peters, MO (US); Jacob Ulkus, Clayton, MO (US)

(73) Assignee: Elan-Polo, Inc., St. Louis, MO (US)

( * ) Notice: Subject to any disclaimer, the term of this patent is extended or adjusted under 35 U.S.C. 154(b) by 1581 days.

(21) Appl. No.: 10/866,972

(22) Filed: Jun. 14, 2004

(65) Prior Publication Data

US 2005/0097783 A1 May 12, 2005

(51) Int. Cl.
*A43C 15/02* (2006.01)
*A43C 13/04* (2006.01)

(52) U.S. Cl. ..... 36/67 A; 36/59 R; 36/67 D

(58) Field of Classification Search ..... 36/113–116, 36/126–128, 7.7, 7.6, 67 D, 67 A, 67 R, 59 C, 36/59 B See application file for complete search history.

(56) References Cited

U.S. PATENT DOCUMENTS

| | | | | | |
|---|---|---|---|---|---|
| 527,403 | A | * | 10/1894 | Buxton | 36/59 R |
| 1,087,212 | A | | 2/1914 | Caldwell | |
| 1,743,285 | A | * | 1/1930 | Richardson | 36/59 R |
| D136,208 | S | | 8/1943 | Ghez et al. | |
| 2,394,454 | A | | 2/1946 | Kappeler | |
| 2,888,756 | A | * | 6/1959 | Parsons | 36/59 R |
| 3,063,171 | A | * | 11/1962 | Hollander | 36/59 R |
| 4,135,317 | A | | 1/1979 | Ikeda | |
| 4,180,923 | A | | 1/1980 | Dassler | |
| 4,393,604 | A | * | 7/1983 | Crowley | 36/67 R |
| 4,527,344 | A | | 7/1985 | Mozena | |
| 4,667,425 | A | | 5/1987 | Effler et al. | |
| 4,914,838 | A | * | 4/1990 | Ihlenburg | 36/114 |
| 5,363,573 | A | | 11/1994 | Kilgore et al. | |
| 5,628,129 | A | * | 5/1997 | Kilgore et al. | 36/134 |
| 5,752,332 | A | | 5/1998 | Kataoka et al. | |
| 6,314,662 | B1 | | 11/2001 | Ellis, III | |
| 6,557,270 | B2 | | 5/2003 | Nakano et al. | |
| 6,705,027 | B1 | | 3/2004 | Campbell | |
| 2004/0000075 | A1 | * | 1/2004 | Auger et al. | 36/128 |

* cited by examiner

*Primary Examiner* — Jila Mohandesi
(74) *Attorney, Agent, or Firm* — Dority & Manning, P.A.

(57) ABSTRACT

An athletic shoe having an improved cleat arrangement is provided. An improved cleat having a v-shape is also provided. An angled or v-cleat is provided near the first metatarsal region to provide improved traction for a wide variety of sports.

9 Claims, 5 Drawing Sheets

ATHLETIC SHOE HAVING AN IMPROVED CLEAT ARRANGEMENT AND IMPROVED CLEAT

FIELD

The present invention relates to an improved cleat arrangement for an athletic shoe and improved cleat. While the present invention is not limited to use with a baseball shoe, certain embodiments of the present invention provide an improved cleat and an improved cleat arrangement for a baseball shoe.

BACKGROUND

Sports such as baseball require players to constantly start and stop as well as shift from side to side and move back and forth on unstable surfaces. Athletic shoes for use in baseball and other sports have conventionally been provided with a plurality of cleats to add stability while the wearer is maneuvering during play. Numerous types of cleats exist that add stability during play. Also, numerous patterns have been developed for positioning cleats on athletic shoes. However, a need exists for an improved cleat. A need also exists for an athletic shoe that will better allow the wearer to maintain traction during forward motion while also allowing the wearer to quickly change direction of movement. Thus, an improved cleat and an athletic shoe with an improved cleat arrangement that provides the wearer with added traction during the forward pushoff is desirable. In addition, an athletic shoe with an improved cleat arrangement that will provide faster directional response as well as better support and cornering is also desirable.

SUMMARY OF THE INVENTION

Objects and advantages of the invention will be set forth in part in the following description, or may be obvious from the description, or may be learned through practice of the invention. The present invention relates to an improved cleat and an athletic shoe with an improved cleat arrangement. In one exemplary embodiment of the present invention, a v-cleat for an athletic shoe is provided. The v-cleat has a plate with a first end and second end. A first cleat with an inner surface extends perpendicularly from the first end of the plate and a second cleat with an inner surface extends perpendicularly from the second end of the plate. The first and second cleat are positioned in a manner such that the inner surfaces at least partially face each other and are configured to form a v-shape.

In certain embodiments, the v-cleat may be made from a metal. Also, in certain embodiments, a strut may be positioned adjacent to each end of the plate. In certain embodiments, the plate may define an opening. Also, in certain embodiments, the v-cleat may be made from a thermoplastic polyurethane.

In another exemplary embodiment of the present invention, a v-cleat for an athletic shoe is provided. The v-cleat has a connector plate with a top surface, a bottom surface, a front surface and a rear surface. The front and rear surfaces have a curved shape with the front surface being wider than the rear surface. The connector plate also has two side surfaces that extend from the front surface to the rear surface. A pair of cleats is also provided. Each cleat has an inner surface and an outer surface and extends upwardly from each said side surface. The cleats are generally perpendicular to the connector plate such that the cleats are configured to form a v-shape.

In still another exemplary embodiment of the present invention, an athletic shoe is provided. The athletic shoe has a first metatarsal region with a front surface and a rear surface. The athletic shoe has a medial side and a lateral side as well as a middle portion and a forefoot portion. A v-cleat configured from a pair of cleats that form a v-shape is also provided. The v-cleat has a plate with a first end and second end. A first cleat with an inner surface extends perpendicularly from the first end of the plate and a second cleat with an inner surface extends perpendicularly from the second end of the plate. The first and second cleat are positioned in a manner such that the inner surfaces at least partially face each other and are configured to form a v-shape. The v-cleat is positioned near the rear portion of the first metatarsal region with the inner surfaces at least partially facing the front portion of the first metatarsal region. A first toe cleat and second toe cleat are positioned proximate to one another near the top portion of the first metatarsal region.

In yet another exemplary embodiment of the present invention, an athletic shoe is provided. The athletic shoe has a first metatarsal region with a front portion and a rear portion. The athletic shoe has a medial side and a lateral side as well as a middle portion and a forefoot portion. A v-cleat configured from a pair of cleats that form a v-shape is also provided. The v-cleat has a connector plate with a top surface, a bottom surface, a front surface and a rear surface. The front and rear surfaces have a curved shape with the front surface being wider than the rear surface. The connector plate also has two side surfaces that extend from the front surface to the rear surface. A pair of cleats is also provided. Each cleat has an inner surface and an outer surface and extends upwardly from each said side surface. The cleats are generally perpendicular to the connector plate such that the cleats are configured to form a v-shape. The v-cleat is positioned near the rear portion of the first metatarsal region with the inner surfaces at least partially facing the front portion of the first metatarsal region. A first toe cleat and second toe cleat are positioned proximate to one another near the top portion of the first metatarsal region. A lateral cleat is positioned proximate to the lateral side of the athletic shoe. The lateral cleat has a ground-engaging surface with a front end and a rear end. The front end of the ground-engaging surface is arranged toward the forefoot portion of the athletic shoe while the rear end of the ground-engaging surface is arranged toward the middle portion of the athletic shoe.

These and other features, aspects, and advantages of the present invention will become better understood with reference to the following description and appended claims. The accompanying drawings, which are incorporated in and constitute a part of this specification, illustrate an embodiment of the invention and, together with the description, serve to explain the principles of the invention.

BRIEF DESCRIPTION OF THE DRAWINGS

A full and enabling disclosure of this invention, including the best mode known to one of ordinary skill in the art, is set forth in this specification. The following Figures illustrate an exemplary embodiments of the present invention.

DETAILED DESCRIPTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in or are apparent from the following detailed description.

The present invention is directed to an improved cleat and an athletic shoe with a uniquely effective cleat arrangement. The present invention provides improved traction and support for athletic activities. While the present invention is particularly well suited for a baseball shoe, it could be utilized for athletic shoes in football, rugby, golf, and many other sports.

The present invention is adapted to advantageously provide traction for forward and lateral movement by focusing on areas of the foot where such movement originates and is supported. The bone structure of the foot is important in determining the pressure points of the shoe where the wearer's weight is applied. Very generally, weight is projected to the foot between the rearfoot and the forefoot. The forefoot is comprised of the lesser tarsus and five major bones referred to as the first, second, third, fourth, and fifth metatarsal. Of the weight carried by the forefoot, much of the weight is transferred to the first and fifth metatarsal areas of the foot. As used herein, medial refers to the inside of the wearer's foot and lateral refers to the outside of the wearer's foot. The present invention achieves greatly improved traction and support by focusing cleat placement to the first and fifth metatarsal areas of the foot.

Generally, a cleat is a projection from the bottom of a shoe that provides added traction. The cleats of the present invention can be made of thermoplastic polyurethane (TPU), metal, rubber or any other material as will be understood by one of ordinary skill in the art using the teachings disclosed herein. The cleats may be molded from the same material as the sole of the athletic shoe or may be secured to the sole by glue or some other method known to one of ordinary skill in the art. In addition, a textured surface or other features may be added to provide a non-slip surface on the ground-engaging portion of the cleat.

Figure 1:
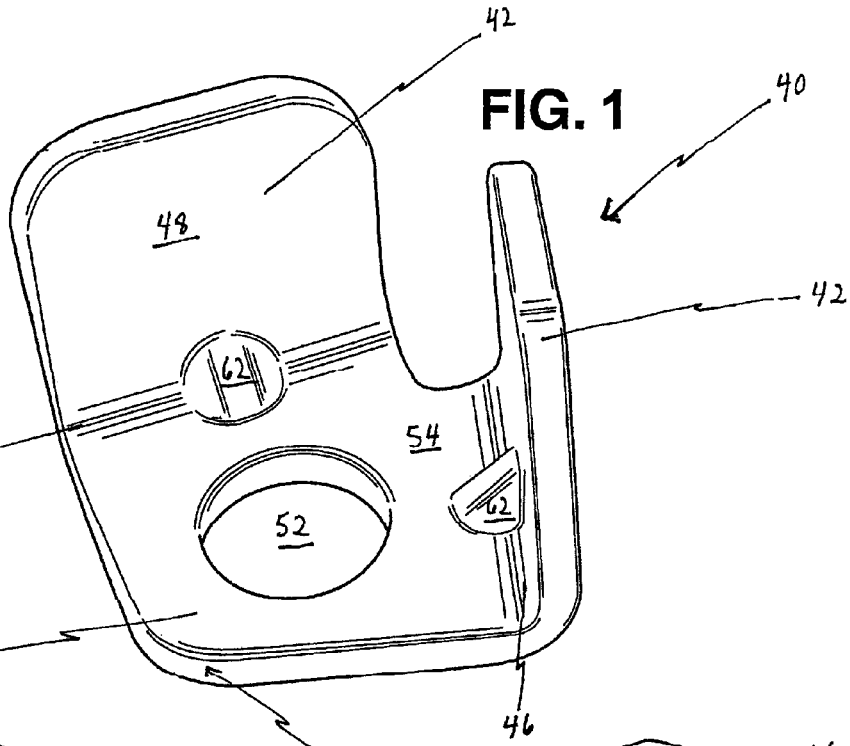
FIGS. 1 and 2 are perspective views of an exemplary embodiment of a v-cleat.
Figure 2:
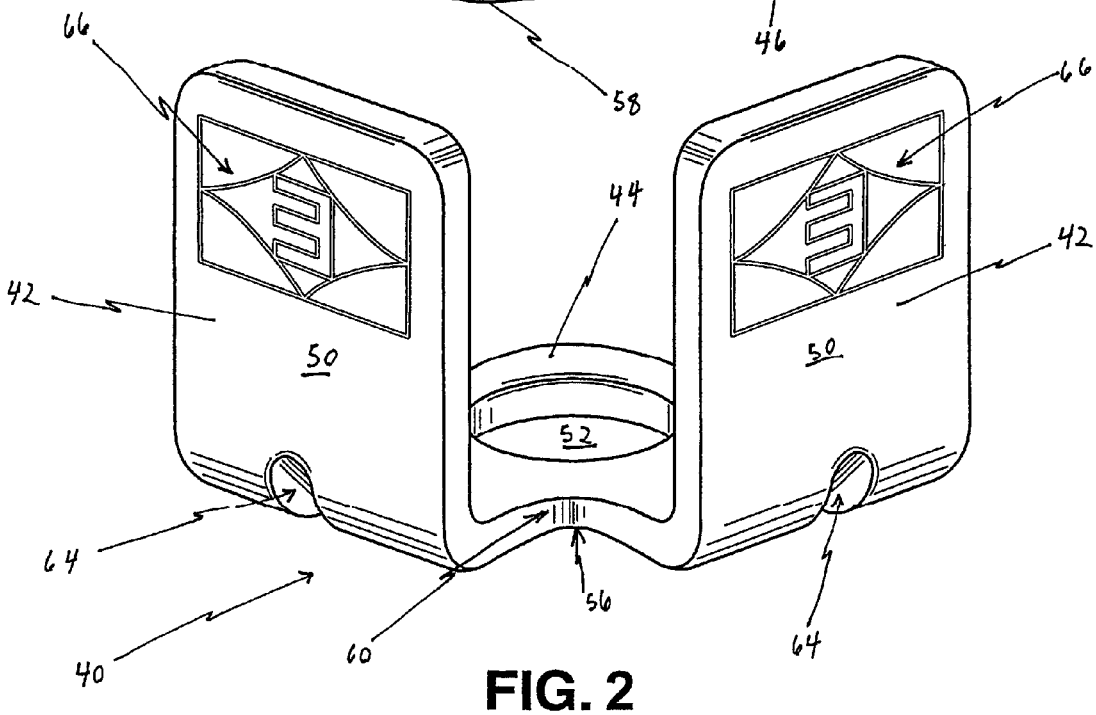

With reference to FIGS. 1-2, an exemplary embodiment of a v-cleat 40 is provided. The v-cleat 40 is a combination of a pair of cleats 42. In a preferred embodiment, the v-cleat 40 is formed from a metal such as steel. The cleats extend integrally upward from a connector plate 44. Specifically, the cleats extend perpendicularly from the ends 46 of the connector plate 44. The cleats 42 have an inner surface 48 and an outer surface 50 and are angled so that they form a v-shape. The inner surfaces 48 of the cleats 42 at least partially face one another. The connector plate 44 defines an opening 52 and has a top surface 54 and a bottom surface 56. In addition, the connector plate 44 has a front surface 58 and a rear surface 60, with the front surface 58 being wider than the rear surface 60.

The v-cleat 40 has a pair of struts 62 which provide structural reinforcement to the cleats 42. Each strut 62 is located adjacent to one of the ends 46 of the connector plate 44 and between the top surface 54 of the connector plate 44 and the inner surface 48 of a cleat 44. Each strut 62 is formed from an indentation 64 in each outer surface 50. For use in an athletic shoe, the v-cleat 40 is usually molded inside of a TPU, PEBAX or other similar material base plate 76 (see FIG. 4) with only the cleats 42 showing. The connector plate 44 that separates the cleats 42 is covered by the base plate 76. The connector plate 44 is generally not visible unless it is molded inside of a transparent base plate 76. The cleats 44 may have a design 66 engraved on one or both of the outer surfaces 50.

Figures 3, 4:
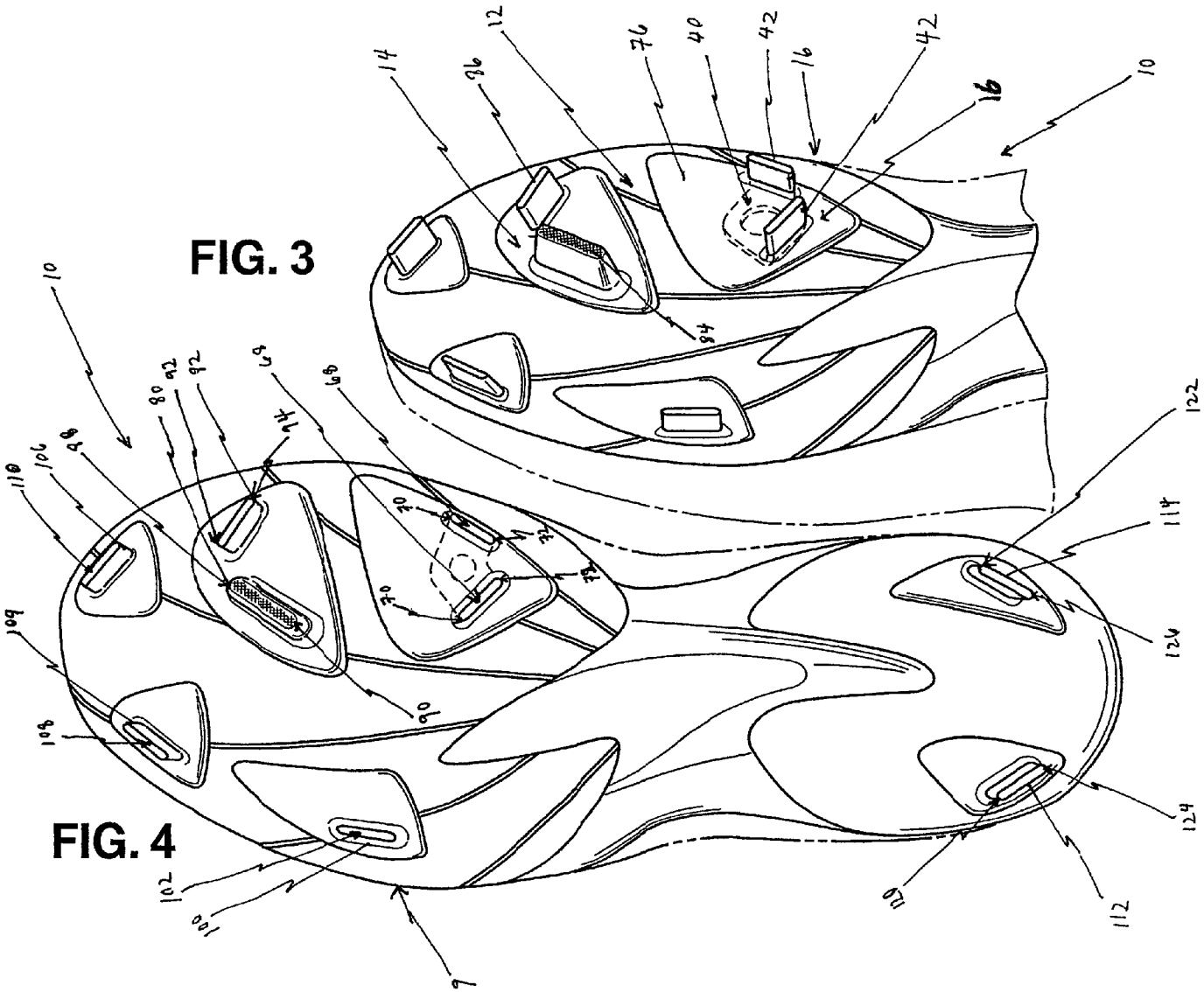
FIG. 3 is a perspective view showing an exemplary embodiment of an athletic shoe.
FIG. 4 is a bottom view of an exemplary embodiment of an athletic shoe.

With reference to FIGS. 3-4, an exemplary embodiment of a v-cleat of the present invention is provided in an athletic shoe 10 that is illustrated having a unique cleat arrangement. The cleats are positioned at the first metatarsal region 12 of the athletic shoe 10. As stated previously, the v-cleat 40 is usually molded inside of a TPU, PEBAX or other similar material base plate 76 with only the metal cleats 42 showing. The connector plate 44 that separates the cleats 42 will be covered by the base plate 76. Cleats 42 are configured to form a v-shape and comprise a v-cleat 40. It should be understood that the present invention is not limited to the precise v-shape shown in the figures; instead, multiple cleat configurations fall within the claims as set forth below and as will be understood by one of ordinary skill in the art. In one embodiment, the v-cleat 40 may have a rectangular and rounded off ground-engaging surface 68, particularly if the v-cleat is formed from metal. The ground-engaging surfaces 68 have a front end 70 and a rear end 72. In the exemplary embodiment of FIGS. 3-4, the two cleats 42 which form the v-cleat 40 are not joined at their rear ends 72. The v-cleat 40 is positioned near the bottom portion 16 of the first metatarsal region 12 of the athletic shoe 10 with the open side of the v-cleat 40 arranged toward the top portion 14 of the first metatarsal region 12. In other exemplary embodiments of the present invention, the ground-engaging surfaces 68 of the v-cleat 40 are connected at their rear ends 72.

The v-cleat 40 improves traction and directional response for the wearer of the athletic shoe 10. The initial movement from a stationary position involves establishing traction for pushing off with the foot. To maximize the amount of traction, it is important to position cleats on the shoe based, in part, upon the bone structure of the foot. The unique shape of the v-cleat 40 surrounds the bottom portion 16 of the first metatarsal region 12 allowing the wearer more traction and stability. The v-cleat 40 allows optimal traction for the wearer during both forward pushoff, as the wearer begins running or fielding, and also at slowdown as the wearer comes to a stop or breaks his run. As the wearer's weight is largely retained over the first metatarsal region of the shoe, the v-cleat 40 provides optimal control. In addition, the v-cleat 40 allows for better cutting or direction of run change to the wearer. These advantages are provided because of the shape and orientation of the v-cleat 40, which acts as a wedge against the ground or other surface.

A first toe cleat 80 and second toe cleat 82 are positioned proximate to one another near the top portion 14 of the first metatarsal region 12 of the athletic shoe 10. The toe cleats 80, 82 increase traction for forward movement for the wearer of the athletic shoe 10. As depicted in FIGS. 3-4, the first toe cleat 80 is formed from TPU and has a generally oval-shaped ground-engaging surface 84. The second toe cleat 26 has a rectangular and rounded off ground-engaging surface 86, but is formed from metal. The ground-engaging surfaces 84, 86 are angled towards one another such that the front ends 88, 92 are closer together than the rear ends 90, 94. The toe cleats 80, 82 provide the wearer with quicker and more positive starting power. Maximum traction for an initial burst of acceleration by the wearer is optimally achieved by the added resistance provided by the toe cleats 80, 82 during the rearward push with the athletic shoe 10.

A lateral cleat 100 is positioned between the top portion 22 and bottom portion 23 of the fifth metatarsal region 20 of the athletic shoe 10, adjacent to the lateral side 11 of the athletic shoe 10. The lateral cleat 100 is positioned to provide optimal support and cornering for the wearer of the athletic shoe 10. The lateral cleat 100 provides optimum traction for the variation of directional movements of the wearer. During sideward movement, the lateral cleat 100 helps prevent the wearer's foot from rolling and allows full sideward movement by utilizing the shifting weight pattern of the foot. The lateral cleat 100 has a rectangular and rounded off ground-engaging surface 102.

In some embodiments, a fourth toe cleat 104 and fifth toe cleat 106 are positioned proximate to one another near the forefoot portion 24 of the athletic shoe 10. The fourth toe cleat 104 has a ground-engaging surface 108 and the fifth toe cleat 106 has a ground-engaging surface 110. A first heel cleat 112 and second heel cleat 114 are positioned near the heel portion 28 of the athletic shoe 10. The first heel cleat 112 has a ground-engaging surface 116 and the second heel cleat 114 has a ground-engaging surface 118. The ground-engaging surface 116 of the first heel cleat 112 has a front 120 and rear 124 and the ground-engaging surface 118 of the second heel cleat 114 has a front 122 and rear 126. The first heel cleat 112 and second heel cleat 114 are substantially symmetrically placed opposite one another with the first heel cleat 112 positioned at the lateral side 11 of the athletic shoe 10 and the second heel cleat 114 is positioned at the medial side 9 of the athletic shoe. The first heel cleat ground-engaging surface 116 and the second heel cleat ground-engaging surface 118 are angled towards one another in a manner such that the front ends 120, 122 of the ground-engaging surfaces 116, 118 are farther apart than the rear ends 124, 126.

Figure 5:
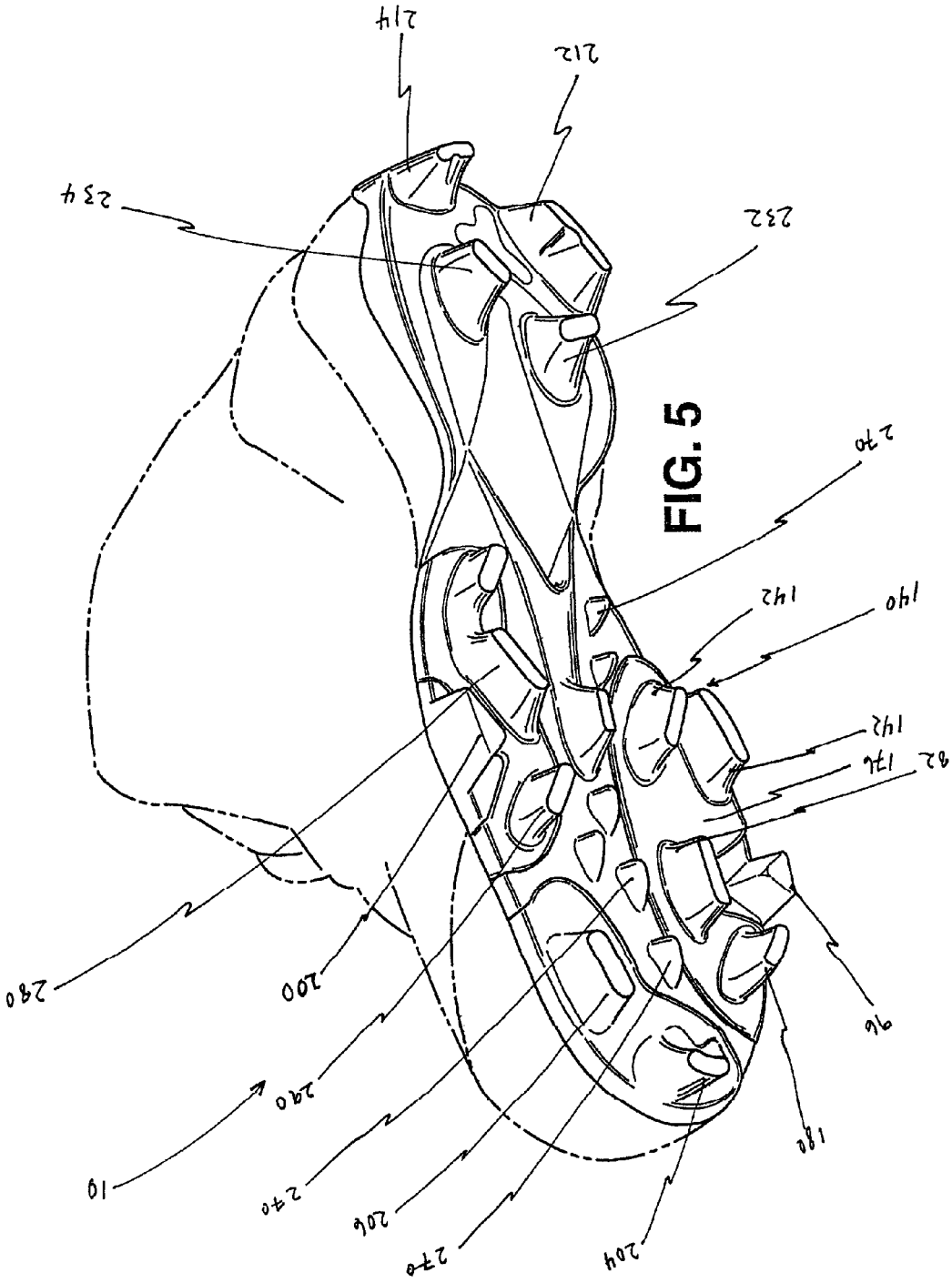
FIGS. 5 and 6 are perspective views showing an exemplary embodiment of an athletic shoe.
Figure 6:
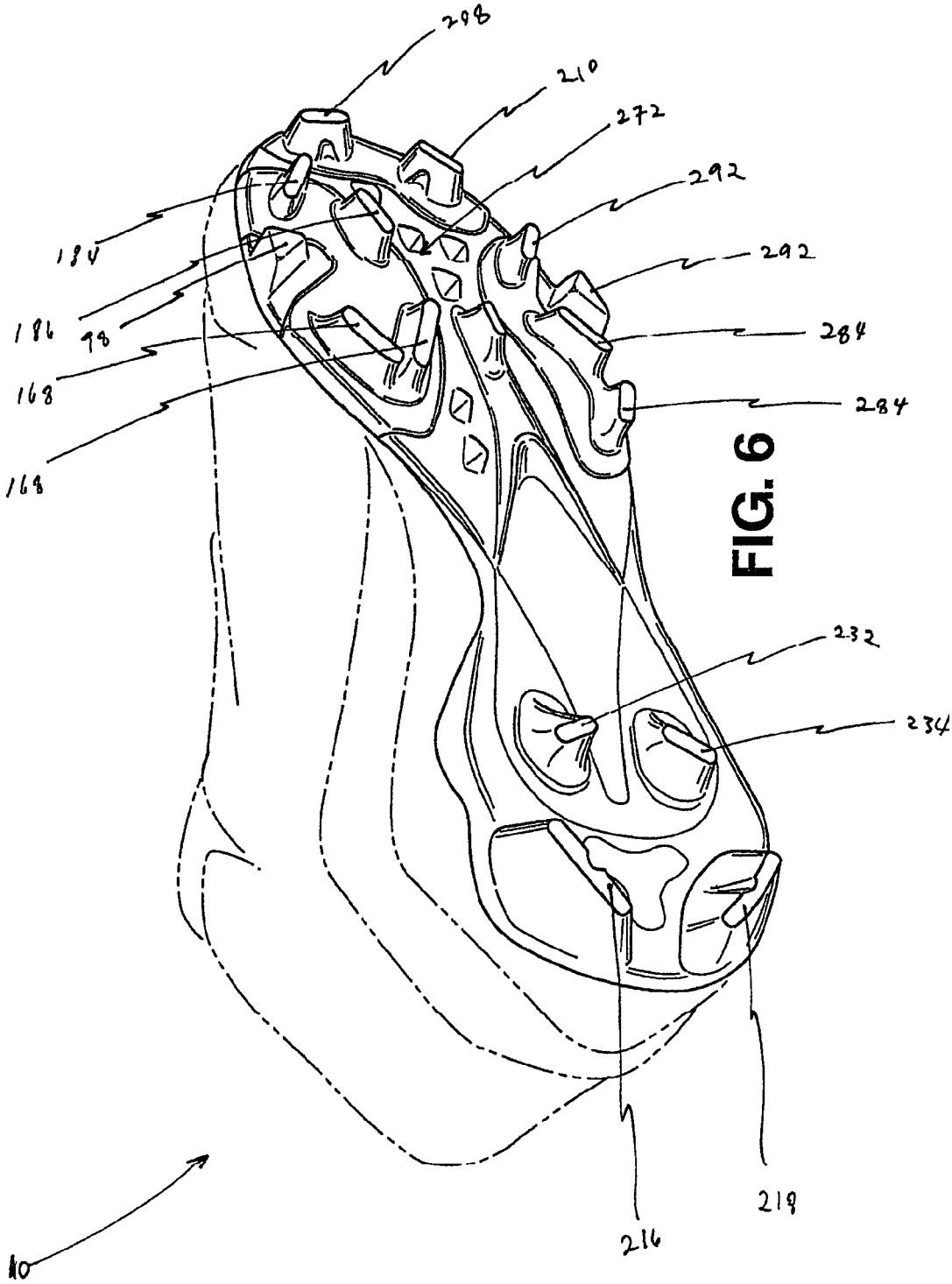
Figure 7:
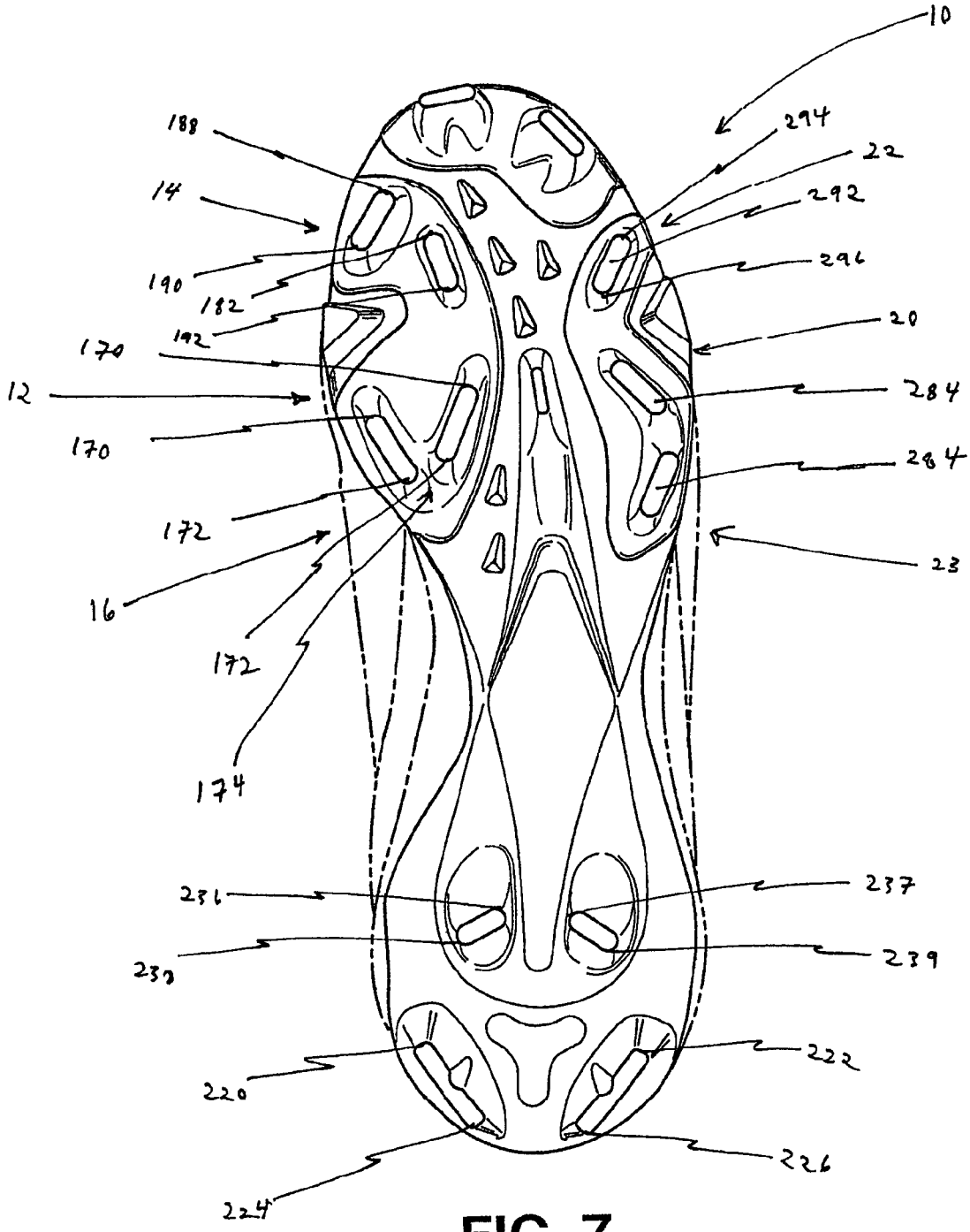
FIG. 7 is a bottom view of an exemplary embodiment of an athletic shoe.

With reference to FIGS. 5-7, in another exemplary embodiment of the present invention, a v-cleat 140 molded within the base plate 176 is positioned at the first metatarsal region 12 of the athletic shoe 10. Cleats 142 are configured to form a v-shape and comprise a v-cleat 140. In an exemplary embodiment, the v-cleat 140 is molded inside of a TPU, PEBAX or other similar material base plate. In addition, the two metal cleats 142 are molded in TPU, PEBAX or other similar material as well. Thus, the connector plate as well as the cleats 142 will be covered by the base plate material. It should be understood that the present invention is not limited to the precise v-shape shown in the figures; instead, multiple cleat configurations fall within the claims as set forth below and as will be understood by one of ordinary skill in the art. The v-cleat 140 has generally oval-shaped ground-engaging surfaces 168. The ground-engaging surfaces 168 have a front end 170 and a rear end 172. In the exemplary embodiment of FIGS. 5-7, the two cleats 142 which form the v-cleat 140 are conjoined at their base 174. The v-cleat 140 is positioned near the bottom portion 16 of the first metatarsal region 12 of the athletic shoe 10 with the open side of the v-cleat 140 arranged toward the top portion 14 of the first metatarsal region 12. In other exemplary embodiments of the present invention, the ground-engaging surfaces 168 of the v-cleat 140 are not connected at their rear ends 172 and the v-cleat 140 is not conjoined at the base 174.

A first toe cleat 180 and second toe cleat 182 are positioned proximate to one another near the top portion 14 of the first metatarsal region 12 of the athletic shoe 10. The toe cleats increase traction for forward movement for the wearer of the athletic shoe 10. The first toe cleat 180 and second toe cleat 182 each have a generally oval-shaped ground-engaging surfaces 184, 186. The ground-engaging surface 184 of the first toe cleat 180 has a front 188 and rear 190. The ground-engaging surface 186 of the second toe cleat 182 has a front 192 and rear 194. The second toe cleat ground-engaging surface 186 is positioned closer to the top portion 14 of the first metatarsal region 12 of the athletic shoe 10 than the first toe cleat ground-engaging surface 184 and the first toe cleat ground-engaging surface 184 and the second toe cleat ground-engaging surface 186 are angled towards one another in a manner such that the front ends 188, 192 of the ground-engaging surfaces 184, 186 are closer together than the rear ends 190, 194. The toe cleats 180, 182 provide the wearer with quicker and more positive starting power. Maximum traction for an initial burst of acceleration by the wearer is optimally achieved by the added resistance provided by the toe cleats 180, 182 during the rearward push with the athletic shoe 10.

A medial cleat 96 is positioned between the top portion 14 and bottom portion 16 of the first metatarsal region 12 of the athletic shoe 10, adjacent to the medial side 9 of the athletic shoe 10. The medial cleat 96 is positioned to provide optimal support and cornering for the wearer of the athletic shoe 10. The medial cleat 96 provides optimum traction for the variation of directional movements of the wearer. During sideward movement, the medial cleat 96 helps prevent the wearer's foot from rolling and allows full sideward movement by utilizing the shifting weight pattern of the foot. The medial cleat 96 has a generally triangular shaped ground-engaging surface 98.

For the exemplary embodiments shown in FIGS. 5-7, the athletic shoe 10 includes a plurality of center-line cleats 270 positioned between the first metatarsal region 12 and the fifth metatarsal region 20 of the athletic shoe 10. The cleats 270 are generally positioned along a line extending from the middle portion 26 to the forefoot portion 24 of the athletic shoe 10 and are generally centered between the medial side 9 and lateral side 11 of the shoe. The base 272 of each cleat 270 is generally triangular in shape.

Athletic shoe 10 also includes cleats positioned at the fifth metatarsal region 20 of the athletic shoe 10. Two cleats 282 may be arranged in a manner to form an obtuse angle and to create an obtuse angled cleat 280. The obtuse angled cleat 280 has generally oval-shaped ground-engaging surfaces 284. The obtuse angled cleat 280 is positioned near the bottom portion 23 of the fifth metatarsal region 20 of the athletic shoe 10 with the open side of the obtuse angled cleat 280 opening towards the medial side 9 of the athletic shoe 10. The obtuse angled cleat 280 is positioned to provide optimal support and cornering for the wearer of the athletic shoe 10. More specifically, obtuse angled cleat 280 is particularly beneficial in providing traction for lateral movement by the wearer.

In addition, a third toe cleat 290 is positioned near the top portion 22 of the fifth metatarsal region 20 of the athletic shoe 10. The third toe cleat 290 has a generally oval-shaped ground-engaging surface 292. The ground-engaging surface has a front 294 and rear 296. In some embodiments, a lateral cleat 200 is positioned between the top portion 22 and bottom portion 23 of the fifth metatarsal region 20 of the athletic shoe 10 adjacent to the lateral side 11 of athletic shoe 10. The front 294 of the ground-engaging surface 292 of the third toe cleat 290 is angled toward the lateral cleat 200. The lateral cleat 200 has a generally triangular shaped ground-engaging surface 292.

A fourth toe cleat 204 and fifth toe cleat 206 are also positioned proximate to one another near the forefoot portion 24 of the athletic shoe 10. The fourth toe cleat 204 has a ground-engaging surface 208 and the fifth toe cleat 206 has a ground-engaging surface 210. A first heel cleat 212 and second heel cleat 214 are positioned near the heel portion 28 of the athletic shoe 10. The first heel cleat 212 has a ground-engaging surface 216 and the second heel cleat 214 has a ground-engaging surface 218. The ground-engaging surface 216 of the first heel cleat 212 has a front 220 and rear 224 and the ground-engaging surface 218 of the second heel cleat 214 has a front 222 and rear 226. The first heel cleat 212 and second heel cleat 214 are substantially symmetrically placed opposite one another with the first heel cleat 212 positioned at the lateral side 11 of the athletic shoe 10 and the second heel cleat 214 is positioned at the medial side 9 of the athletic shoe. The first heel cleat ground-engaging surface 216 and the second heel cleat ground-engaging surface 218 are angled towards one another in a manner such that the front ends 220, 222 of the ground-engaging surfaces 216, 218 are farther apart than the rear ends 224, 226.

For the exemplary embodiment shown in FIGS. 5-7, a third heel cleat 228 and fourth heel cleat 230 are positioned near the heel portion 28 of the athletic shoe 10 between the middle portion 26 and heel portion 28 of the athletic shoe 10. The third heel cleat 228 has a ground-engaging surface 232 and the fourth heel cleat 234 has a ground-engaging surface 234. The ground-engaging surface 232 of the third heel cleat 228 has a front 236 and rear 238 and the ground-engaging surface 234 of the fourth heel cleat 230 has a front 237 and rear 239. The third heel cleat ground-engaging surface 232 and the fourth heel cleat ground-engaging surface 234 are angled towards one another in a manner such that the front ends 236, 237 of the ground-engaging surfaces 232, 234 are closer together than the rear ends 238, 239.

While exemplary embodiments of the present invention have been described utilizing various cleat configurations, it should be understood that the present invention is not limited to only these configurations as will be understood by one of ordinary skill in the art using the teaching disclosed herein. It should be appreciated by those skilled in the art that modifications and variations can be made to the exemplary embodiment of athletic shoe 10 as described herein, without departing from the scope and spirit of the claims. It is intended that the invention include such modifications and variations as come within the scope of the appended claims and their equivalents.

What is claimed is:

1. A v-cleat for an athletic shoe comprising:

a connector plate, said connector plate having a top surface, a bottom surface, a front surface and a rear surface, said front surface and rear surface both having a curved shape with said front surface being at least twice as wide as said rear surface, said connector plate having two side surfaces which each extend from said front surface to said rear surface, said connector plate defining an opening extending from said top surface to said bottom surface; and a pair of cleats, said connector plate and said pair of cleats being integral, each said cleat having an inner surface, an outer surface, a first edge and a second edge, said cleats extending upward from each said side surface generally perpendicular to said connector plate such that said cleats are configured to form a v-shape, the first edge of each said cleat being adjacent to said front surface, the second edge of each said cleat being adjacent to said rear surface, wherein the distance between said first edges of each said cleat is at least twice the distance of that between said second edges of each said cleat.

2. A v-cleat as set forth in claim 1, wherein said v-cleat is made from a metal.

3. A v-cleat as set forth in claim 1, wherein said v-cleat is made from thermoplastic polyurethane.

4. A v-cleat as set forth in claim 1, further comprising a pair of struts, each said strut positioned adjacent to one said side surface of said connector plate between said top surface of said connector plate and one said inner surface of said cleats.

5. An athletic shoe, said athletic shoe comprising:

an outsole and a v-cleat, said v-cleat comprising:

a connector plate, said connector plate and said pair of cleats being integral, said connector plate having a top surface, a bottom surface, a front surface and a rear surface, said front surface and rear surface both having a curved shape with said front surface being at least twice as wide as said rear surface, said connector plate having two side surfaces which each extend from said front surface to said rear surface, said connector defining an opening extending from said top surface to said bottom surface that is filled with material used to form the outsole, said connector plate being molded into said outsole; and a pair of cleats, each said cleat having an inner surface, an outer surface, a first edge and a second edge, said cleats extending upward from each said side surface generally perpendicular to said connector plate such that said cleats are configured to form a v-shape, the first edge of each said cleat being adjacent to said front surface, the second edge of each said cleat being adjacent to said rear surface, wherein the distance between said first edges of each said cleat is at least twice the distance of that between said second edges of each said cleat.

6. An athletic shoe as set forth in claim 5, wherein said outsole made from thermoplastic polyurethane.

7. An athletic shoe as set forth in claim 5, wherein said v-cleat is made from metal.

8. An athletic shoe as set forth in claim 5, wherein said v-cleat is made from thermoplastic polyurethane.

9. An athletic shoe as set forth in claim 5, wherein said v-cleat further comprises a pair of struts, each said strut positioned adjacent to one said side surface of said connector plate between said top surface of said connector plate and one said inner surface of said cleats.

* * * * *